US006090187A

United States Patent [19]

Kumagai

[11] Patent Number: 6,090,187

[45] Date of Patent: Jul. 18, 2000

[54] APPARATUS AND METHOD FOR REMOVING PARTICULATES IN EXHAUST GAS OF AN INTERNAL COMBUSTION ENGINE COLLECTED BY EXHAUST PARTICULATE REMOVER APPARATUS

[75] Inventor: Yasuaki Kumagai, Yokohama, Japan

[73] Assignee: Mitsubishi Jidosha Kogyo Kabushiki Kaisha, Tokyo, Japan

[21] Appl. No.: 09/054,447

[22] Filed: Apr. 3, 1998

[30] Foreign Application Priority Data

Apr. 4, 1997 [JP] Japan ..... 9-086656

[51] Int. Cl.[7] ..... B01D 29/52; B01D 29/62; F01N 3/02

[52] U.S. Cl. ..... 95/278; 95/283; 95/286; 55/282.3; 55/283; 55/287; 55/DIG. 10; 55/DIG. 30; 96/400; 96/402; 96/405; 96/421; 60/303; 60/311

[58] Field of Search ..... 55/282.3, 283, 55/284, 286, 287, 312, 523, DIG. 10, DIG. 30, 350.1; 95/278, 283, 286; 96/400, 402, 405, 425, 426, 428, FOR 103, FOR 104, FOR 106, FOR 168, FOR 169, 421; 60/295, 303, 311

[56] References Cited

U.S. PATENT DOCUMENTS 5,085,049 2/1992 Rim et al. ..... 55/DIG. 30
5,458,673 10/1995 Kojimia et al. ..... 55/DIG. 30

FOREIGN PATENT DOCUMENTS 60-184917 9/1985 Japan ..... 60/303
3-134215 6/1991 Japan .
6-307225 11/1994 Japan .

*Primary Examiner*—David A. Simmons
*Assistant Examiner*—Robert A. Hopkins

[57] ABSTRACT

Two filters provided in an exhaust path of an internal combustion engine are used to simultaneously collect particulate in an exhaust gas and are alternately refreshed. When a refresh timing of the filters comes, a determination is made as to which of the filters has a larger accumulation amount. The plurality of filters are refreshed in an order from the filter determined as having the larger accumulation amount, and variation of accumulation amounts of particulate of the filters is corrected, so that both of the filters are refreshed within a tolerable temperature range.

24 Claims, 8 Drawing Sheets

APPARATUS AND METHOD FOR REMOVING PARTICULATES IN EXHAUST GAS OF AN INTERNAL COMBUSTION ENGINE COLLECTED BY EXHAUST PARTICULATE REMOVER APPARATUS

BACKGROUND OF THE INVENTION

The present invention relates an apparatus and method for removing particles from gas, exhausted from an internal combustion engine, by a plurality of filters.

Particles (or exhaust particles), containing carbon as a main component, are contained in an gas exhausted from an internal combustion engine of an automobile, particularly from a diesel engine.

Therefore, an exhaust particulate remover apparatus having a filter made of ceramics is provided in an exhaust path of a diesel engine and particulate in an exhaust gas is collected by the filter, in order to remove the particulate.

As particulate thus collected is accumulated and increases, ventilation of the filter is deteriorated gradually and, finally, the filter must be refreshed. Besides, it is necessary to continue cleaning the exhaust gas while reclaiming the filter.

In order to simultaneously achieve both the cleaning and reclaiming, a proposal has been made as to a structure as follows (in Japanese Patent Application KOKAI Publication No. 3-134215). Two sets (or a plurality) of filters are provided in parallel in an exhaust path of a diesel engine. As shown in FIG. 8, collection of particulate is carried out simultaneously by two filters (designated at No. 1 and No. 2). Based on a determination as to collection amounts, only one (No. 1) of the filters is refreshed when a refresh timing comes. While reclaiming the filter, the gas, exhausted gas is made to flow through the other filter (No. 2) so that the exhaust gas is kept cleaned and exhausted. At the timing when reclaiming of the filter (No. 1) is completed, the mode of collecting the exhaust gas is switched to simultaneous collection using two filters (No. 1 and No. 2).

However, in the above kind of exhaust particulate remover apparatus as described above, a large thermal load may be applied to a filter when reclaiming a filter.

This relates to cinders of particulate caused by the reclaiming process.

Specifically, reclaiming of each filter is carried out by burning accumulated particulate on the filter with the use of a heating source such as an electric heater or the like. Since the reclaiming is carried out within a certain predetermined time period, cinders of particulate tend to be easily caused on the filter. The amount of cinders varies particularly depending on how particulate is burnt (e.g., the burning temperature or the like) and a difference in the amount of cinders represents a difference in accumulation amount of particulate collected between the filters.

The difference in accumulation amount of particulate may be considered to be eliminated when particulate is collected by simultaneously using two sets of filters. In practice, however, a refresh timing comes before the difference is eliminated, and therefore, the difference in accumulation amount cannot be eliminated. In addition, the collection amount, from which a refresh timing is determined, is a total accumulation amount of particulate collected by two sets of filters, but the accumulation amount of each filter cannot be acquired.

Therefore, as shown in FIG. 9, there is a case where particulate accumulated in the filter No. 2 reaches an accumulation amount at which the particulate burns at a burning temperature higher than the tolerable temperature of the filter, for example, if the filter No. 1 is refreshed prior to the filter No. 2 among two sets of filters where the accumulation amount of the filter No. 1 is smaller than an average value of the accumulation amounts of the filters No. 1 and No. 2 and the accumulation amount of the filter No. 2 is greater than the average value.

This means that the inner temperature of the filter exceeds a tolerable temperature (or a tolerable value) when reclaiming the filter No. 2, and a large thermal load is applied thereby deteriorating the durability of the filter.

Hence, a proposal has been made as to the order in which the filters No. 1 and No. 2 are subjected to reclaiming is changed periodically, e.g., every time when the two sets of filters are refreshed (in Japanese Patent Application KOKAI Publication No. 6-307225).

However, if the refresh order is changed every time when the two sets of filters are refreshed, the collection amounts of the filters No. 1 and No. 2 change alternately as shown in FIG. 10. Therefore, as can be seen from reclaiming for first and second times, the particulate amount accumulated on the filter change greatly when reclaiming the filters.

Thus, when reclaiming any of the filters No. 1 and No. 2, the internal temperature of the filter often exceeds a tolerable temperature (or tolerable value), and as a result, the durability of the filters No. 1 and No. 2 is deteriorated. Needless to say, the durability of the filters is deteriorated even if the refresh order is changed periodically.

Hence, there has been a demand for an apparatus which is capable of reclaiming filters while improving the durability of filters.

BRIEF SUMMARY OF THE INVENTION

The present invention has been made in view of the above situation, and has an object of providing an apparatus and method for removing particles from gas exhausted from an internal combustion engine, which is capable of alternately reclaiming a plurality of filters within a tolerable temperature range.

In order to achieve the above object, in the apparatus and method according to the present invention, a determination is made as to which filter has a larger accumulation amount and a plurality of filters are refreshed in an order from the filter determined as having the larger accumulation amount, thereby to correct the accumulation amounts of the filters which may vary, so that all the filters can be refreshed within a tolerable temperature range.

As a result, the temperature of filters can be maintained to be substantially constant when reclaiming filters, and therefore, the durability of the filters can be improved.

According to a preferred embodiment of the present invention, the filter having a larger accumulation amount can be easily determined depending on whether or not an accumulation amount of particulate of a filter exceeds an average value obtained by dividing a total accumulation amount by the number of filters.

Also according to a preferred embodiment of the present invention, one of filters can be determined as having a larger accumulation amount than the other filter by means of a simple structure, in which an exhaust gas is made to flow through only one of filters, and an accumulation of particulate is detected from a pressure difference between an inlet and an outlet of the one filter with respect to a flow amount of an exhaust gas passing through the filter.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

In the following, the present invention will be explained with reference to an embodiment shown in FIGS. 1 to 7.

Figure 1:
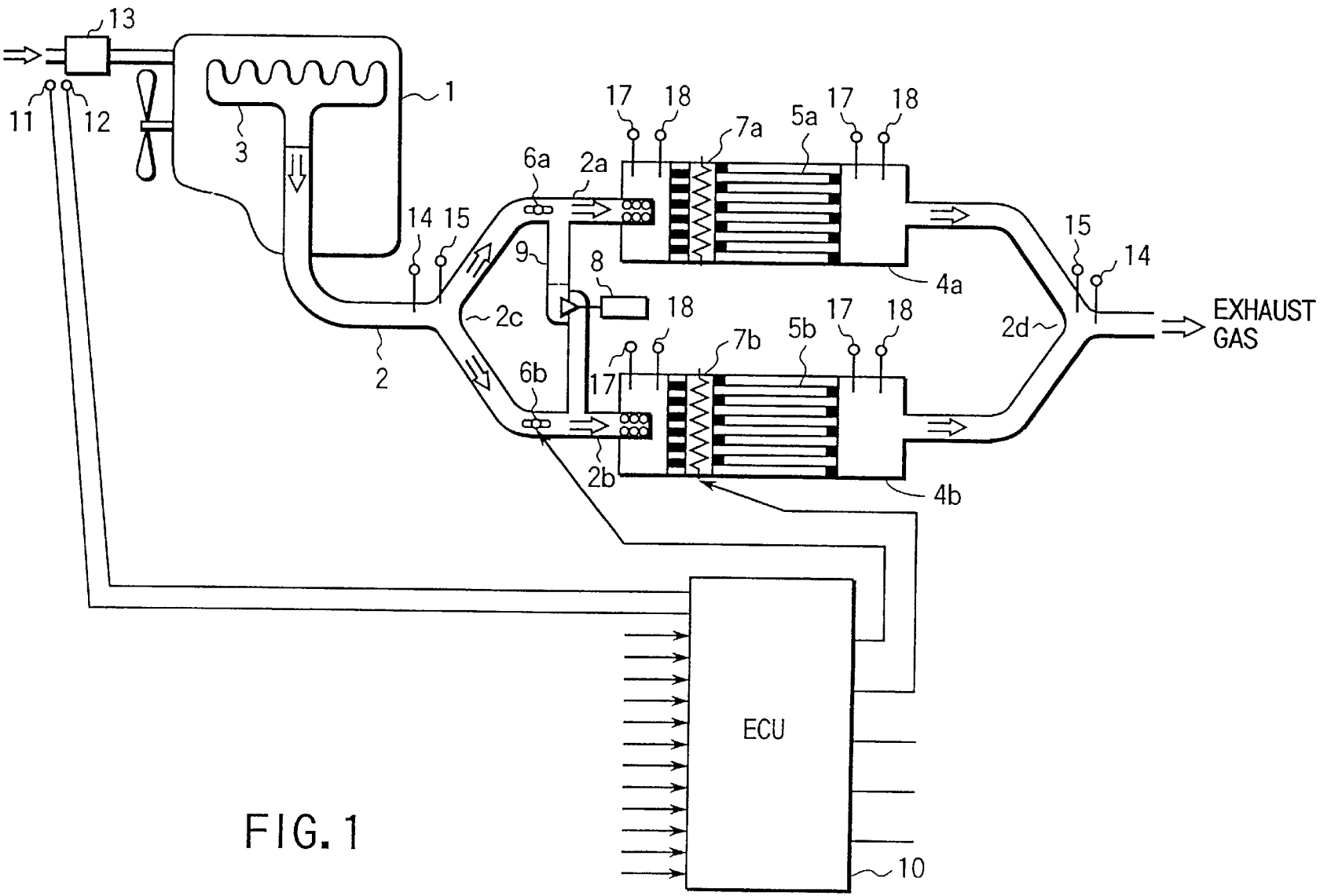
FIG. 1 is a view showing a schematic structure of an exhaust particulate remover apparatus with a simultaneous parallel collection state, according to an embodiment of the present invention.

FIG. 1 shows a schematic structure of an exhaust particulate remover apparatus of a simultaneous-collection/alternate-reclaiming system to which the present invention is applied. In the figure, reference numeral 1 denotes an internal combustion engine such as a diesel engine, and reference numeral 2 denotes an exhaust pipe (or an exhaust path) connected to an exhaust manifold 3 of the diesel engine 1.

The exhaust pipe 2 is branched into two pipe lines 2*a* and 2*b* which are joined together again and reach a muffler (not shown). Reference numerals 2*c* and 2*d*, respectively, denote a branch portion and a junction portion. For example, cylindrical casings 4*a* and 4*b* are connected on ways of pipe lines 2*a* and 2*b*, respectively. Filters for collecting particulate in an exhaust gas, e.g., diesel particulate filters 5*a* and 5*b* (which will be referred to as No. 1 and No. 2 filters hereinafter) are provided in the casings 4*a* and 4*b*, respectively, and the No. 1 and No. 2 filters 5*a* and 5*b* are arranged in parallel to the exhaust pipe 2.

Each of the No. 1 and No. 2 filters 5*a* and 5*b* are formed of a cylindrical honeycomb film made of porous material such as ceramics or the like and including partitions, and each filter internally comprises a number of paths (or filter cells) surrounded by partitions. The paths are closed paths, and the inlet sides and the outlet sides of the paths are alternately closed by plugs made of ceramics. When an exhaust gas flowing into No. 1 and No. 2 filters 5*a* and 5*b* passes through the wall surface of the paths, particulate in the exhaust gas is collected.

Switch valves 6*a* and 6*b* for opening/closing the pipe lines 2*a* and 2*b* are respectively provided at pipe line portions of the casings 4*a* and 4*b* in the inlet side, and an exhaust gas is made to flow simultaneously through both the No. 1 and No. 2 filters 5*a* and 5*b* or flow through only one of the No. 1 and No. 2 filters 5*a* and 5*b* by opening/closing operation of the switch valves 6*a* and 6*b*.

Heaters used for reclaiming, such as electric heaters 7*a* and 7*b* are respectively provided for the No. 1 and No. 2 filters 5*a* and 5*b* at the inlet sides thereof, and are arranged to ignite particulate accumulated in the filters 5*a* and 5*b* when reclaiming the filters.

A pipe line portion between the switch valve 6*a* and the casing 4*a* and a pipe line portion between the switch valve 6*b* and the casing 4*b* are connected with each other through a reclaiming gas path 9 which is opened/closed by a control valve 8. By opening/closing the control valve 8, an exhaust gas (or reclaiming gas) for transmitting fire generated inside the No. 1 and No. 2 filters 5*a* and 5*b* can be introduced to the No. 1 filter 5*a* or No. 2 filter 5*b*.

Meanwhile, a ECU 10 (comprising a microcomputer) connected with the switch valves 6*a* and 6*b*, electric heaters 7*a* and 7*b*, and control valve 8 is supplied with an ability of control necessary for simultaneous-collection/alternate-reclaiming, such as a simultaneous parallel collection function, a both-filter accumulation amount detect function, a refresh timing determination function, a single-filter accumulation amount detection function, a refresh order selection function, and an alternate reclaiming execution function.

The simultaneous parallel collection function is a function of opening the switch valves 6*a* and 6*b* and closing the control valve 8, to make an exhaust gas flow through the No. 1 and No. 2 filters 5*a* and 5*b* so that particulate is collected by both of the filters.

The both-filter accumulation detection function is a function of detecting a total accumulation amount of the two sets of filters 5*a* and 5*b*, with use of a relation that the particulate accumulated on the filters increases and the pressure loss of the filters accordingly increases, as the exhaust gas flow amount passing through the filters increases. For example, an intake air flow amount, obtained on the basis of detection signals from an intake air temperature sensor 11, an intake air pressure sensor 12, and an intake air amount sensor 13 (such as an air-flow sensor), of the diesel engine 1 is corrected by using detection signals from an exhaust gas temperature sensor 14 and an exhaust gas pressure sensor 15 provided at the branch portion 2*c*, to calculate an exhaust gas flow amount, while a loss (or differential pressure) to be obtained is detected from a pressure detected by the exhaust gas pressure sensors 15 provided at the branch portion 2*c* and the junction portion 2*d*, to detect a total accumulation amount of particulate of the No. 1 and No. 2 filters with respect to an exhaust gas flow amount. (This function corresponds to total accumulation amount detection means).

Figure 3:
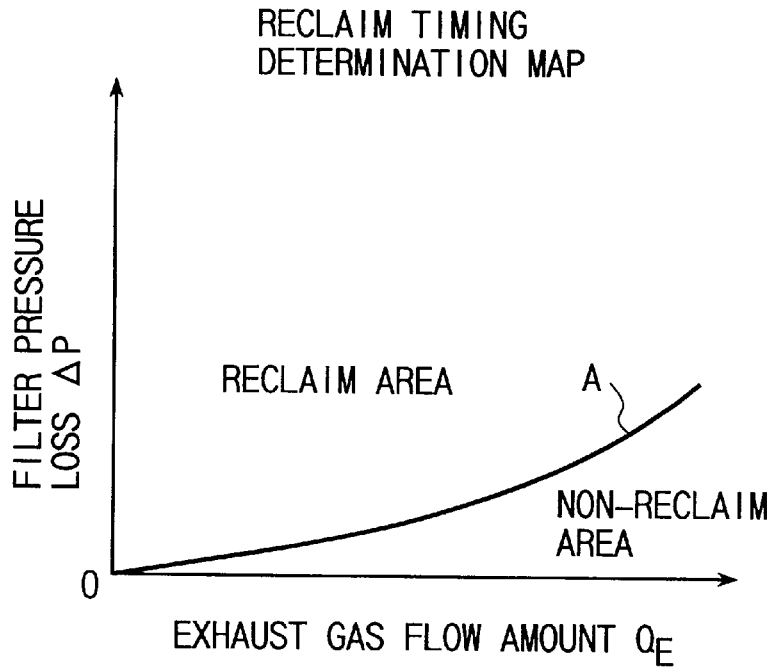
FIG. 3 is a graph showing a map for determining a refresh timing of a filter.

The refresh timing determination function is a function of preparing a refresh timing determination map having a line of a threshold value for determining whether or not the particulate amount of the two sets of filters reaches a predetermined amount requiring reclaiming of filters as shown in FIG. 3, i.e., a predetermined refresh start determination line A determined from a relation between an exhaust gas flow amount (weight) and a pressure loss of the filters, to determine start of reclaiming of No. 1 and No. 2 filters 5*a* and 5*b*, depending on whether or not the total particulate amount detected by both-filter accumulation amount detection function exceeds the refresh start determination line A.

The single filter accumulation amount detection function is a function of detecting an accumulation amount of one of the No. 1 and No. 2 filters 5*a* and 5*b* when a determination of starting reclaiming is made. Specifically, the switch valve 6*b* of the No. 2 filter 5*b* is closed to make an exhaust gas from the diesel engine 1 flow only through the No. 1 filter 5*a*, and the accumulation amount of the No. 1 filter 5*a* is detected from calculation of an exhaust gas flow amount and detection of a pressure loss (or differential pressure) between the inlet and outlet sides of the No. 1 filter 5*a*, with use of exhaust gas temperature sensors 17 and exhaust gas pressure sensor for the No. 1 filter 5*a* among exhaust gas temperature sensors 17 and exhaust gas pressure sensors 18 provided at the inlet and outlet sides of the No. 1 and No. 2 filters 5*a* and 5*b*, like the above-mentioned case of detecting the total accumulation amount.

Figure 4:
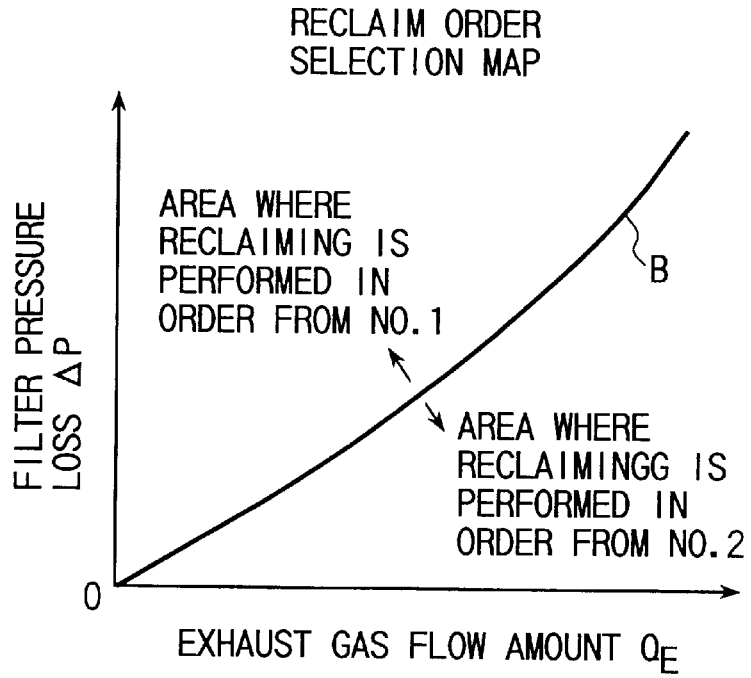
FIG. 4 is a graph showing a map for determining whether or not an accumulation amount of a filter is large and for selecting an order in which filters are refreshed.

The refresh order selection function is a function of preparing a refresh order selection map having a line of a threshold line set from an half accumulation amount of the total accumulation amount of the No. 1 and No. 2 filters 5*a* and 5*b*, as shown in FIG. 4, i.e., a refresh order determination line B (representing an average value obtained by dividing the total accumulation amount by the number of filters), to determine that the accumulation amount of the No. 1 filter 5*a* is large and the accumulation amount of the No. 2 filter 5*b* is small, when the particulate accumulation amount of the No. 1 filter 5*a* detected by the single-filter accumulation amount detection function exceeds the refresh order determination line B. (This function corresponds to detection means)

By combining the refresh order selection function and the single-filter accumulation amount detection function, a determination is made as to which of the No. 1 and No. 2 filters 5*a* and 5*b* has a greater accumulation amount when the total accumulation amount of the No. 1 and No. 2 filters 5*a* and 5*b* reaches a refresh timing. (This corresponds to determination means.)

In the alternate reclaiming execution function, for example, in the refresh order selection map shown in FIG. 4, the area of the accumulation amount exceeding the refresh order determination line B is set as an area where reclaiming is instructed in an order from the No. 1 filter 5*a* to the No. 2 filter 5*b*, while the area on and below the refresh order determination line B is set as an area where reclaiming is inversely instructed in an order of No. 1 filter 5*a* to the No. 2 filter 5*b*, so that the No. 1 and No. 2 filters 5*a* and 5*b* are subjected to reclaiming processing in an order from the filter having a greater accumulation amount. Further, reclaiming of the No. 1 and No. 2 filters 5*a* and 5*b* are executed. (This corresponds to refresh means.) Specifically, execution of reclaiming of the No. 1 filter 5*a* is carried out by closing the switch valve 6*a* of the No. 1 filter 5*a*, opening the switch valve 6*b* of the No. 2 filter 5*b*, rendering the electric heater 7*a* of the No. 1 filter 5*a* electrically conductive, and opening the control valve 8 at a timing delayed from the timing when the electric heater 7*a* is rendered conductive. Reclaiming of the No. 2 filter 5*b* is carried out by closing the switch valve 6*b* of the No. 2 filter 5*b*, opening the switch valve 6*a* of the No. 1 filter 5*a*, rendering the electric heater 7*b* of the No. 2 filter 5*b* electrically conductive, and opening the control valve 8 at a timing delayed from the timing when the electric heater 7*a* is rendered conductive.

By the functions as described above, the No. 1 and No. 2 filters 5*a* and 5*b* are arranged to be refreshed alternately with their filter temperatures maintained substantially constant.

Figure 5A:
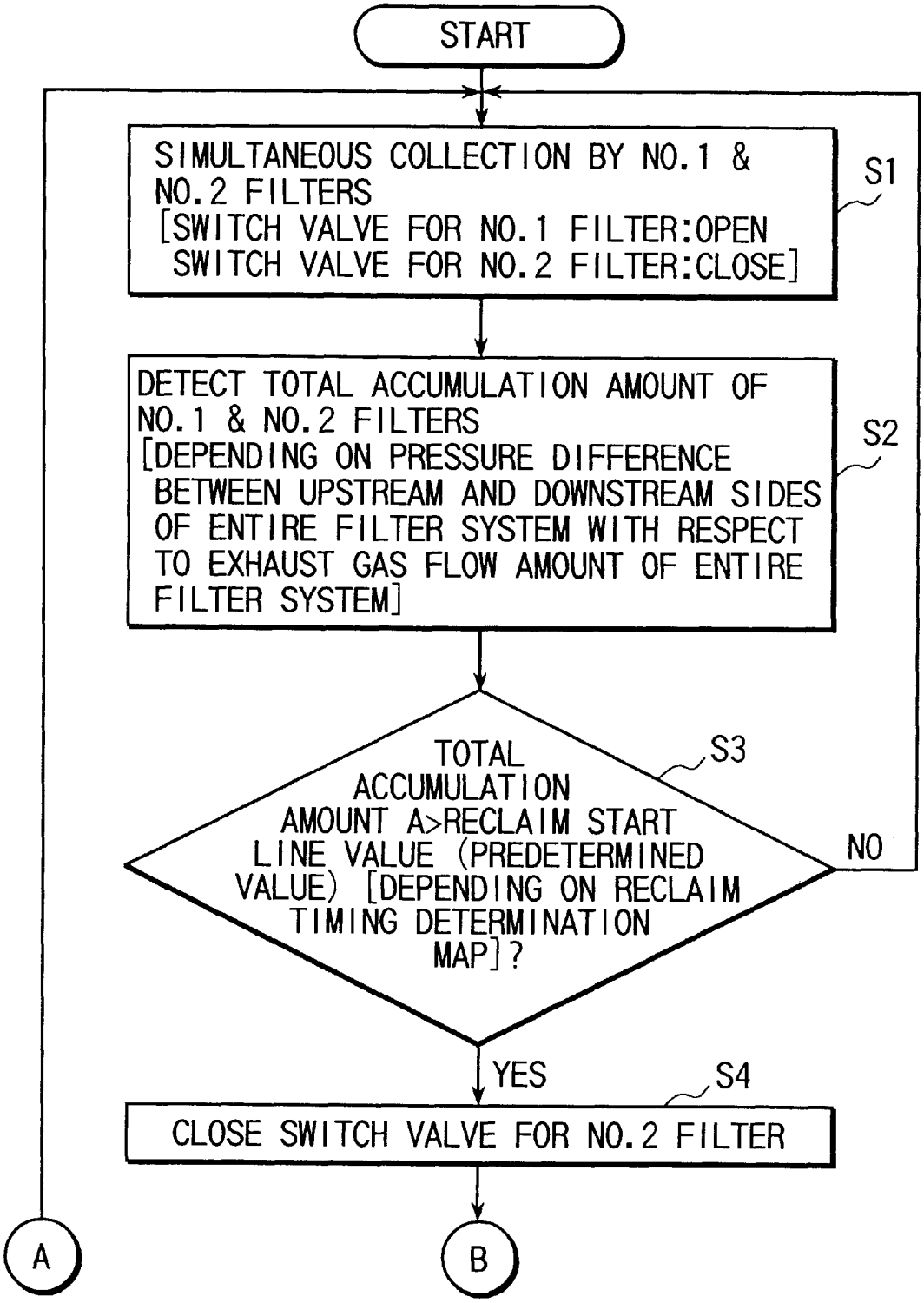
FIGS. 5A and 5B is a flowchart for explaining control in which a plurality of filters are refreshed in an order from the filter having the largest accumulation amount.
Figure 5B:
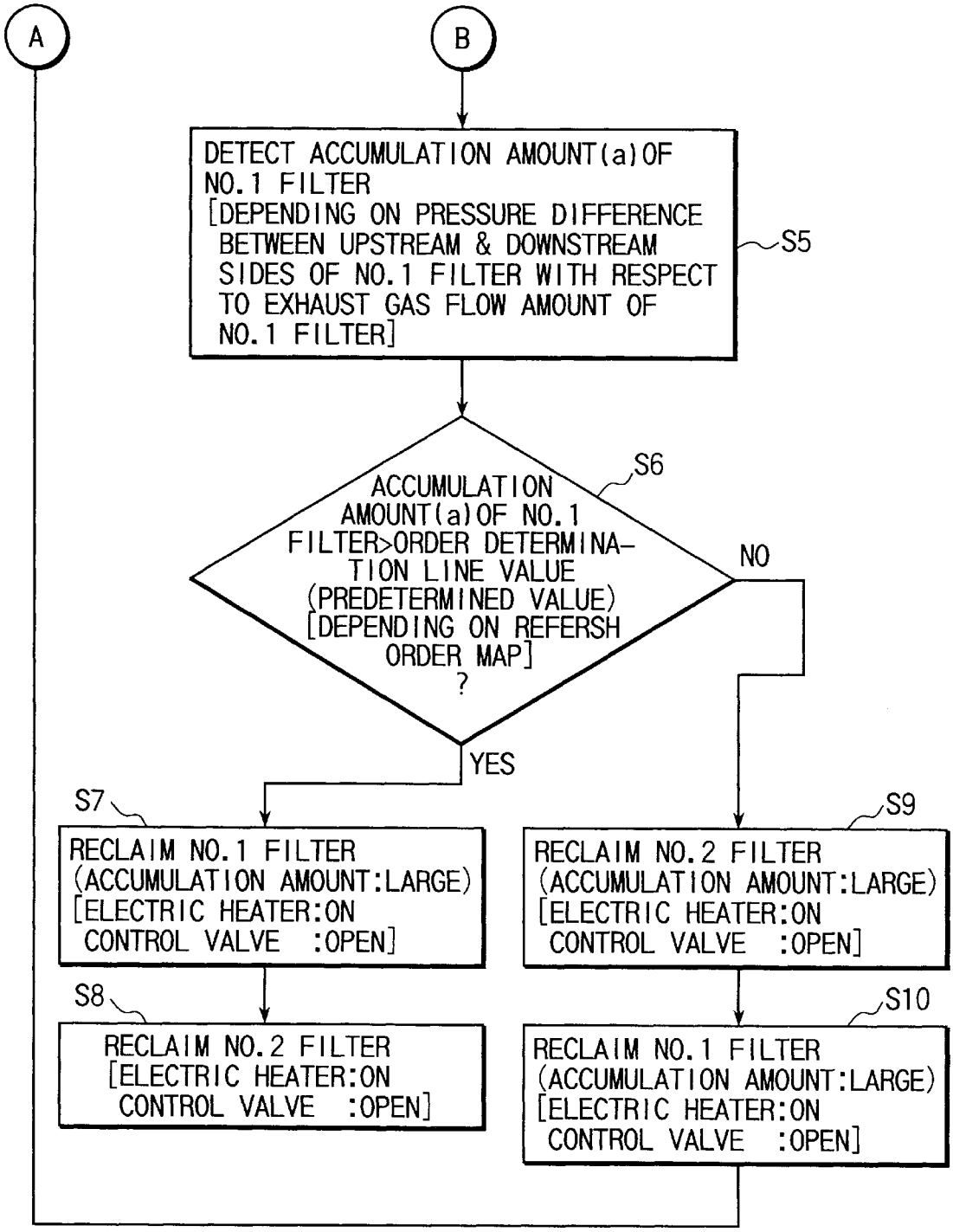
Figure 6:
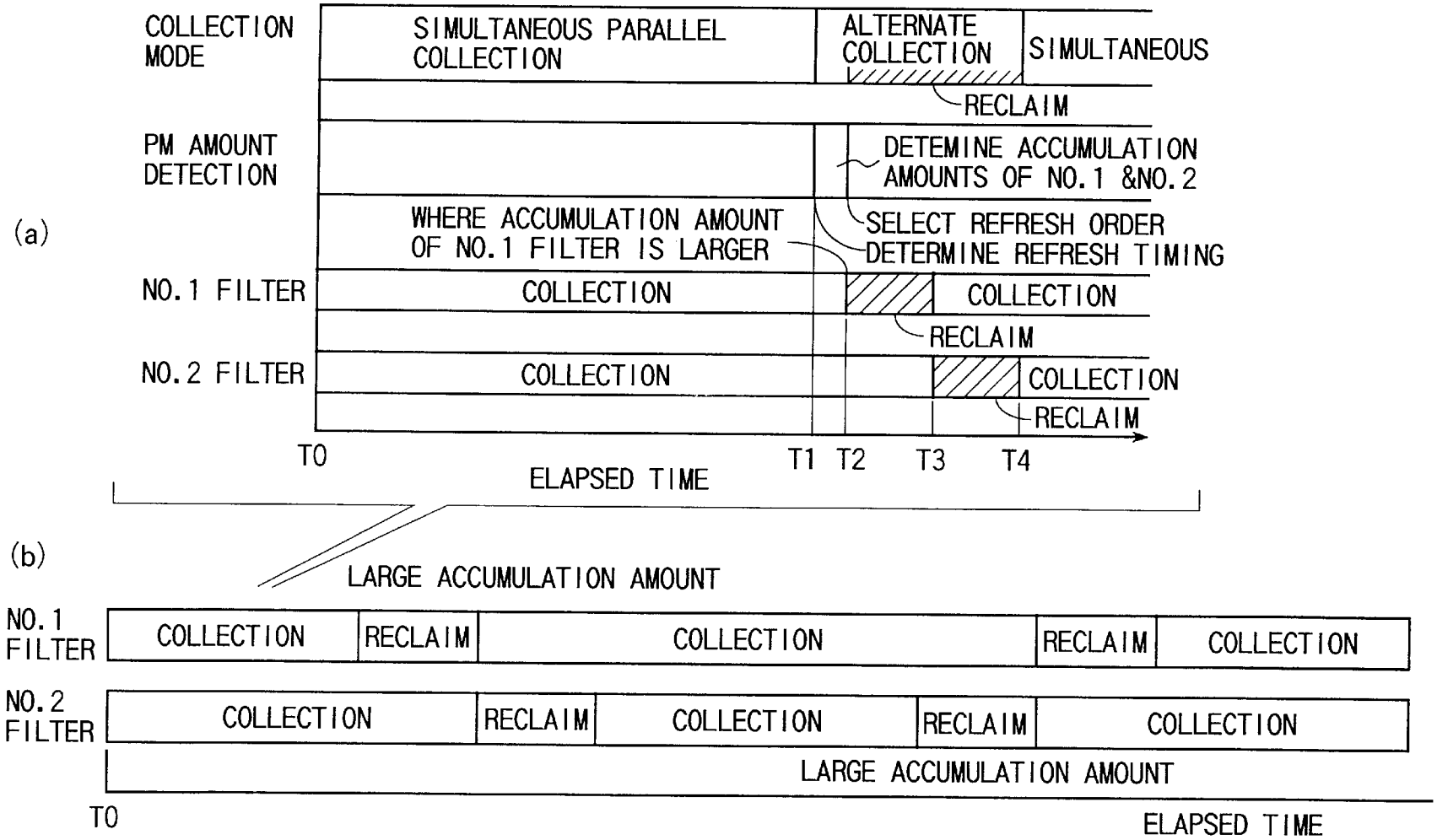
FIG. 6 is a view for explaining simultaneous parallel collection of an exhaust particulate remover apparatus, and a mode in which reclaiming of filters are alternately repeated in an order from the filter having the largest accumulation amount.

FIG. 5 shows a flowchart of alternately reclaiming the No. 1 and No. 2 filters 5*a* and 5*b* in this state. FIGS. 6(*a*) and 6(*b*) show procedures of the steps.

Next, with reference to FIGS. 5 and 6, explanation will be made of an operation of the exhaust particulate remover apparatus supposing that the exhaust particulate remover apparatus is now in a collection mode of simultaneous parallel correction.

In this mode, the switch valves 6*a* and 6*b* of the filters 5*a* and 5*b* are opened and the control valve 8 is closed (in a step S1).

An exhaust gas exhausted from the diesel engine 1 flows through both of the pile lines 2*a* and 2*b* and is introduced to the filters 5*a* and 5*b* (in a state shown in FIG. 1).

While the exhaust gas is passing through the filters 5*a* and 5*b*, particulate contained in the exhaust gas is collected by the filters 5*a* and 5*b*.

Mean while, the ECU 10 calculates an exhaust gas flow amount of the exhaust gas flowing into the No. 1 and No. 2 filters 5*a* and 5*b*, with use of detection values from the exhaust gas temperature sensors 14 and the exhaust gas pressure sensors 15 provided at the branch portion 2*c* and the junction portion 2*d*, and also detects a differential pressure, i.e., a pressure loss between the upstream and downstream sides of the No. 1 and No. 2 filters 5*a* and 5*b*, thereby to detect the amount of particulate accumulated in the No. 1 and No. 2 filters 5*a* and 5*b*, i.e., the total accumulation amount A of the No. 1 and No. 2 filters 5*a* and 5*b* (in a step S2).

The simultaneous parallel collection continues, and when the total accumulation amount A exceeds the refresh start determination line value A (shown in FIG. 3) as a reference for determining a refresh timing of the No. 1 and No. 2 filter 5*a* and 5*b*, the ECU 10 determines that the refresh timing of the No. 1 and No. 2 filters 5*a* and 5*b* has come (in a step S3).

Then, the ECU 10 goes into a mode for determining respective accumulation amounts of the No. 1 and No. 2 filters 5*a* and 5*b*.

Figure 2:
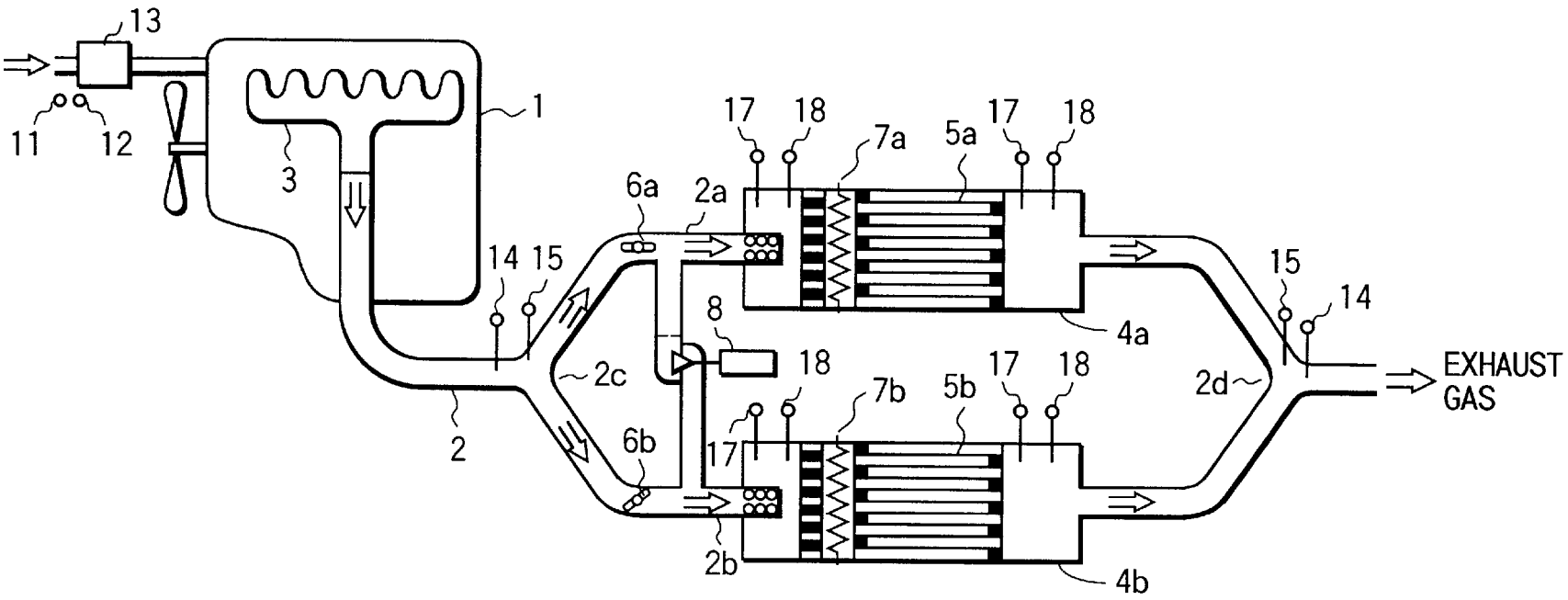
FIG. 2 is a view for explaining a state of detecting a filter having a greater accumulation amount of particulate.

Specifically, at first, the ECU 10 closes one of the switch valves 6*a* and 6*b*, e.g., the switch valve 6*b* for the No. 2 filter 5*b* in this case (in a step S4). As a result, the exhaust gas flows only into the No. 1 filter 5*a*, as shown in FIG. 2.

Subsequently, the ECU 10 calculates the exhaust gas flow amount of the exhaust gas flowing into and out of the No. 1 filter 5*a*, based on detection values from the exhaust gas temperature sensor 17 and the exhaust gas pressure sensor 18 in the upstream side and the downstream side of the No. 1 filter 5*a*, and detects a differential pressure, i.e., a pressure loss between the upstream and downstream sides of the No.

1 filter 5*a*, thereby to detect an accumulation amount (a) of particulate accumulated in the No. 1 filter 5*a* (in a step S5), which is compared with the refresh order determination line value B (shown in FIG. 4).

Since the refresh order determination line value B is half the refresh start determination line value A, i.e., the half (or average) of the reference value for determining the total accumulation amount A of the No. 1 and No. 2 filters 5*a* and 5*b*, the accumulation amount (a) of the No. 1 filter 5*a* is determined as being larger than the accumulation amount of the No. 2 filter 5*b* if the accumulation amount (a) of the No. 1 filter 5*a* exceeds the refresh order determination line value B from comparison, while the accumulation amount (a) of the No. 1 filter 5*a* is determined as being smaller than the accumulation amount of the No. 2 filter 5*b* if the accumulation amount (a) of the No. 1 filter 5*a* is equal to or less than the refresh order determination line value B (in a step S6). At the same time, the order, in which the filter having a greater accumulation amount is refreshed earlier, is selected, e.g., the order of No. 1 filter 5*a* to No. 2 filter 5*b* is selected when the accumulation amount (a) of the No. 1 filter 5*a* is greater, while the order of No. 2 filter 5*b* to No. 1 filter 5*a* is selected when the accumulation amount (a) of the No. 2 filter 5*b* is greater.

In this state, if the accumulation amount (a) of the No. 1 filter 5*a* is greater than that of the No. 2 filter 5*b*, the ECU 10 firstly refreshes the No. 1 filter 5*a* in accordance with the selection of the refresh order.

Specifically, at first, the ECU 10 closes the switch valve 6*a* for the No. 1 filter 5*a* and opens the switch valve 6*b* of the No. 2 filter 5*b*, to collect particulate by means of the No. 2 filter 5*b* having a smaller accumulation amount (a).

Subsequently, the electric heater 7*a* for the No. 1 filter 5*a* is rendered conductive for a predetermined time period, to heat the No. 1 filter 5*a* to generate fire inside the filter.

Thereafter, the control valve 8 is opened to introduce a part of an exhaust gas, as a reclaiming gas, from the pipe line presently collecting particulate into the No. 1 filter 5*a*, so that particulate is burnt by transmitting fire.

After a preset reclaiming time period is elapsed, the control valve 8 is switched to be closed and the reclaiming processing of the No. 1 filter 5*a* is finished (in a step S7).

Upon completion of the reclaiming processing of the No. 1 filter 5*a*, the No. 2 filter 5*b* is refreshed and the No. 1 filter 5*a* is switched to collection of particulate.

Then, particulate accumulated in the No. 2 filter 5*b* is burnt in the same reclaiming processing as particulate in the No. 1 filter 5*a* is burnt (in a step S8).

If the accumulation amount (a) of the No. 1 filter 5*a* is determined as being smaller than that of the No. 2 filter 5*b* (i.e., the accumulation amount (a) of the No. 2 filter 5*b* is larger than that of the No. 1 filter 5*a*) when selecting the refresh order, the No. 2 filter 5*b* having a greater accumulation amount (a) is refreshed firstly and the No. 1 filter 5*a* having a smaller accumulation amount (a) is then refreshed, in the same manner of reclaiming processing as described above (in steps S9 and S10).

Further, when alternate reclaiming of the No. 1 and No. 2 filters 5*a* and 5*b* is completed, simultaneous parallel collection is recovered again.

Thus, a plurality of filters 5*a* and 5*b* are alternately refreshed such that the plurality of filters are always refreshed in an order from the filter having a larger accumulation amount (a). Therefore, particulate is always accumulated in a filter having a smaller accumulation amount (a) whenever the filter having a larger accumulation amount (a).

Figure 7:
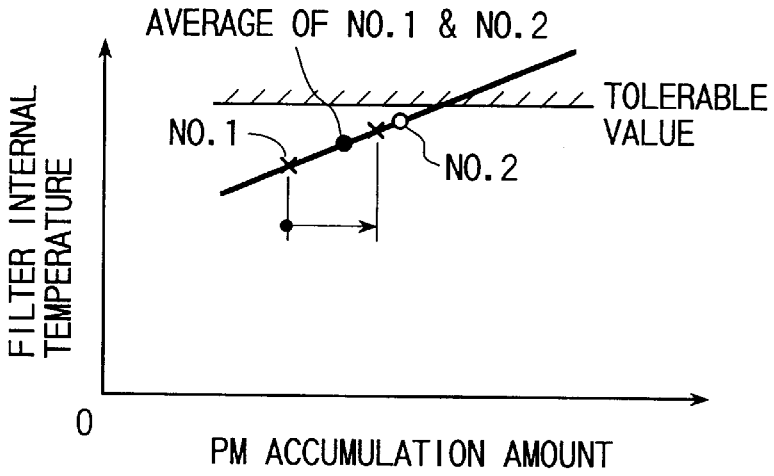
FIG. 7 is a graph for explaining accumulation changes of particulate while reclaiming the filters.
Figure 8:
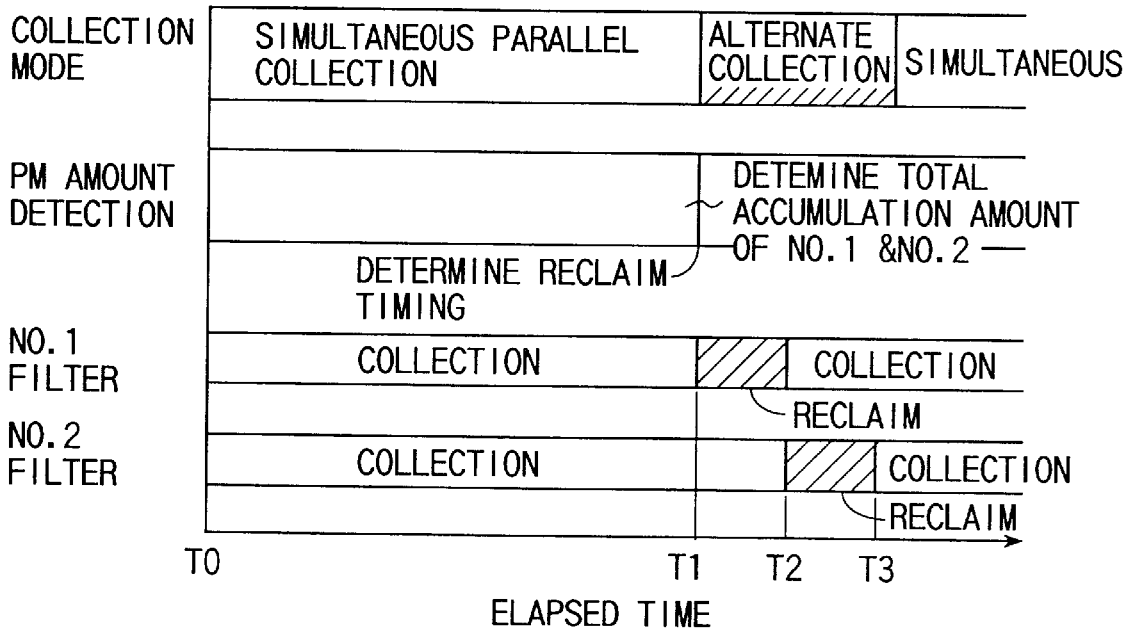
FIG. 8 PRIOR ART
FIG. 8 is a view for explaining simultaneous parallel collection and alternate reclaiming in a conventional exhaust particulate remover apparatus.
Figure 9:
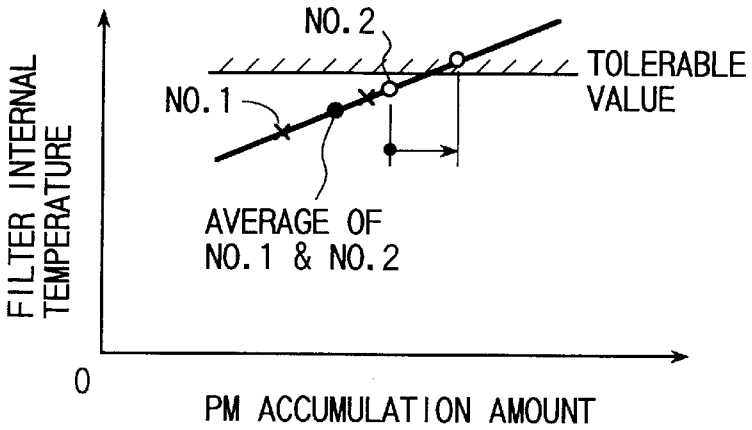
FIG. 9 PRIOR ART
FIG. 9 is a graph for explaining accumulation changes of particulate while reclaiming filters of a conventional exhaust particulate remover apparatus.
Figure 10:
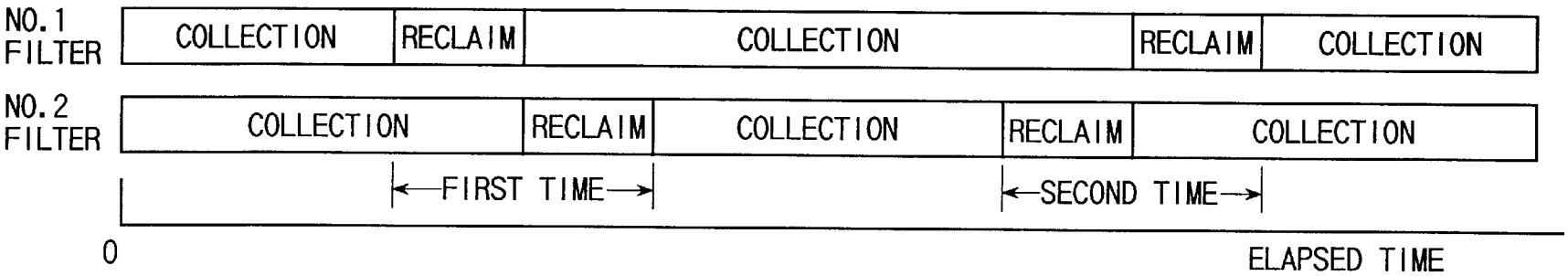
FIG. 10 PRIOR ART
FIG. 10 is a view for explaining alternate reclaiming in another conventional exhaust particulate remover apparatus.

As a result of this, particulate is hindered from being accumulated to an accumulation amount with which the burning temperature of particulate exceeds a tolerable temperature (or tolerable value) of the filter. For example, supposing that the No. 2 filter 5*b* has a larger accumulation amount (a) and the No. 1 filter 5*a* has a smaller accumulation amount (b), the accumulation amount of particulate in the No. 1 filter 5*a* is originally small and particulate is not accumulated to an amount which will cause a burning temperature exceeding the tolerable temperature (or tolerable value) of the No. 1 filter 5*a* even if particulate in an exhaust gas is accumulated on cinders in the No. 1 filter 5*a* during reclaiming of the No. 2 filter 5*b*, as shown in FIG. 7.

In addition, since the behavior as described above results in an effect of correcting variation of accumulation amounts of the filters 5*a* and 5*b*, the filter temperature during alternate reclaiming can be maintained to be substantially constant within a tolerable temperature range.

Therefore, thermal loads to the No. 1 and No. 2 filters 5*a* and 5*b* are restricted and the durability of the filters 5*a* and 5*b* can be improved.

In particular, since the present embodiment adopts a system, in which a determination of a filter having a larger accumulation amount is made depending on whether or not the accumulation amount exceeds the average value obtained by dividing the total accumulation amount by the number of filters, it is possible to easily determine which of the filters has a larger accumulation amount.

Besides, this determination is made by adopting a structure, in which an exhaust gas is made to flow through only one of the filters and an accumulation amount of particulate is detected from a differential pressure between inlet and outlet sides of the filter with respect to a flow amount of the exhaust gas passing through the filter at this time. Therefore, a filter having a larger accumulation amount can be determined with a simple structure.

Although the present invention has been applied to an exhaust particulate remover apparatus for cleaning an exhaust gas from a diesel engine, the present invention is not limited to this apparatus but is applicable to other exhaust particulate remover apparatuses for cleaning an exhaust gas containing particulate from an internal combustion engine.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. An apparatus for removing particulate from an exhaust gas exhausted from an internal combustion engine, comprising:

a plurality of filters provided in parallel in an exhaust path of the internal combustion engine, for simultaneously collecting particulate in the exhaust gas;

total amount detection means for detecting a first value indicative of a total amount of the particulate collected by said plurality of filters;

a plurality of valve means provided to correspond to said plurality of filters, for independently opening/closing the exhaust path to respective filters;

reclaiming timing determination means for determining a timing to reclaim said plurality of filters by comparing the first value with a first predetermined value;

accumulation amount detection means for detecting a second value indicative of an amount of the particulate collected by each of at least one of said plurality of filters, said at least one of said plurality of filters being at least one filter but less than the total number of said plurality of filters;

reclaiming order determination means for determining a filter, among said plurality of filters, that has accumulated the largest amount of the particulate by comparing the second value with a second predetermined value; and reclaiming means for reclaiming, prior to other of said plurality of filters, said filter determined by said reclaiming order determination means and closing the valve means corresponding to said filter determined to be reclaimed during regeneration.

2. The apparatus according to claim 1, wherein said plurality of filters are first and second filters, and the reclaiming order determination means includes detection means for detecting whether or not the second value indicative of an accumulation amount of the particulate in the first filter exceeds the second predetermined value obtained by dividing the first predetermined value by the number of the filters.

3. The apparatus according to claim 2, further comprising:

a valve for directing the exhaust gas to flow only through the second filter, wherein said detection means detects the second value based on a pressure difference between an inlet and outlet of the first filter with respect to a flow amount of the exhaust gas passing through the first filter, and determines that the first filter has the accumulation amount larger than an accumulation amount of the second filter when the second value is equal to or greater than the second predetermined value obtained by dividing the first predetermined value by two.

4. The apparatus according to claim 1, wherein said timing for reclaiming said plurality of filters is determined from a map based on a pressure loss due to said plurality of filters and an exhaust gas flow amount.

5. The apparatus according to claim 1, wherein said reclaiming order determination means determines the filter that has accumulated the most particulate from a map based on a pressure loss due to said one of said plurality of filters and an amount of exhaust gas flow through said one of said plurality of filters.

6. The apparatus according to claim 1, further comprising:

communicating paths for communicating the exhaust gas between each of the valve means and the corresponding filters, and control valve means for controlling a connection between the communicating paths and the exhaust path, wherein said reclaiming means controls said control valve means so that a portion of the exhaust gas otherwise distributed among said plurality of filters is introduced to said filter to be reclaimed via said communicating paths.

7. A method of removing particulate from gas exhausted from an internal combustion engine, comprising:

simultaneously collecting particulate in the exhaust gas by a plurality of filters provided in parallel in an exhaust path of the internal combustion engine;

detecting a first value indicative of a total amount of the particulate collected by said plurality of filters;

determining a timing for reclaiming said plurality of filters by comparing the first value with a first predetermined value;

detecting a second value indicative of an amount of the particulate collected by each of at least one of said plurality of filters, said at least one of said plurality of filters being at least one filter but less than the total number of said plurality of filters;

determining which filter among said plurality of filters has accumulated the most particulate based on the second value when the total accumulation amount of the particulate exceeds a predetermined value;

closing the exhaust path corresponding to said filter determined to have accumulated the most particulate; and reclaiming, prior to the other filters, the filter determined to have accumulated the most particulate.

8. The method according to claim 7, wherein first and second filters are provided as said plurality of filters, and said filter determination step determines whether or not the second value of the first filter exceeds the second predetermined value obtained by dividing the first predetermined value by two.

9. The method according to claim 8, wherein said filter determination step detects the second value, based on a pressure difference between an inlet and an outlet of the first filter with respect to a flow amount of the exhaust gas passing through the first filter.

10. The method according to claim 7, wherein reclaiming the filter determined to have the most particulate includes:

introducing a portion of the exhaust gas otherwise distributed among the other filters as combustion gas to the filter to be reclaimed.

11. An apparatus for reclaiming filters for removing particulate contained in an exhaust gas of an internal combustion engine, comprising:

two filters provided in parallel in an exhaust path of the internal combustion engine, adapted to simultaneously collect the particulate in the exhaust gas;

two valves provided respectively to correspond to said two filters, for independently opening/closing the exhaust path to the corresponding one of said two filters;

a total amount detection unit adapted to detect a first value indicative of a total amount of the particulate collected by said two filters;

a reclaiming timing determination unit adapted to determine a timing to reclaim said two filters by comparing the first value with a first predetermined value;

an accumulation amount detection unit adapted to detect a second value indicative of an amount of the particulate collected by either one of said two filters;

a determination unit adapted to determine a filter, between said two filters, that has accumulated the larger amount of the particulate by comparing the second value with a second predetermined value; and a reclaiming order selecting unit for reclaiming the filter prior to the other of said two filters and a closing valve corresponding to the filter to be reclaimed during regeneration.

12. The apparatus of claim 11, wherein said first value is determined based on a pressure loss at said plurality of filters and an exhaust gas flow amount.

13. The apparatus of claim 12, wherein said first predetermined value is selected from a map based on the pressure loss at said plurality of filters and the exhaust gas flow amount.

14. The apparatus of claim 11, wherein said second predetermined value is determined based on a pressure loss at said either one of said two filters and an exhaust gas flow amount.

15. The apparatus of claim 14, wherein said second predetermined value is determined from a map.

16. The apparatus of claim 11, wherein said second predetermined value is obtained by dividing the first predetermined value by the total number of filters.

17. The apparatus according to claim 11, further comprising:

communicating paths for communicating the exhaust gas between each of the valves and the corresponding filters, and a control valve for controlling a connection between the communicating paths and the exhaust path, wherein said reclaiming order selecting unit controls said control valve so that a portion of the exhaust gas otherwise distributed among said plurality of filters is introduced to said filter to be reclaimed via said communicating paths, as combustion gas during regeneration of said filter.

18. A method for reclaiming filters for removing particulate contained in an exhaust gas of an internal combustion engine, comprising:

simultaneously collecting particulate in the exhaust gas by two filters provided in parallel in an exhaust path of the internal combustion engine;

detecting a first value indicative of a total amount of the particulate collected by the two filters;

determining a reclaiming timing of said two filters by comparing the first value with a first predetermined value;

detecting a second value indicative of an amount of the particulate collected by one of said two filters;

identifying a filter, that has accumulated more particulate between said two filters, by comparing the second value with a second predetermined value;

closing the exhaust path used to communicate exhaust gas with the filter identified as having determined to have accumulated more particulate; and reclaiming the filter determined to have accumulated more particulate, prior to the other of said two filters.

19. The method of claim 18, wherein said detecting step includes, determining a first value based on a pressure loss at said plurality of filters and an exhaust gas flow amount.

20. The method of claim 19, wherein said detecting step includes, selecting a first predetermined value from a map based on a pressure loss at said plurality of filters and the exhaust gas flow amount.

21. The method of claim 18, wherein said filter determining step includes, determining the second predetermined value based on a pressure loss at said either one of said two filters and an exhaust gas flow amount.

22. The method of claim 21, wherein said filter determining step includes, selecting the second predetermined value from a map.

23. The method of claim 18, wherein said filter determining step obtains the second predetermined value by dividing the first predetermined value by the total number of filters.

24. The method according to claim 18, wherein reclaiming the filter determined to have accumulated more particulate includes:

introducing a portion of the exhaust gas otherwise distributed among the other filters as combustion gas to the filter to be reclaimed.

* * * * *